United States Patent [19]

MacElvain et al.

[11] 3,976,567

[45] Aug. 24, 1976

[54] MATERIAL CONCENTRATOR

[76] Inventors: Robert C. MacElvain; Ford M. MacElvain, both of 507 McClure Drive, Opelika, Ala. 36801

[22] Filed: Mar. 3, 1975

[21] Appl. No.: 555,259

[52] U.S. Cl. ..... 209/430; 209/500; 209/506

[51] Int. Cl.[2] ..... B03B 5/08

[58] Field of Search ..... 209/428–433, 209/500, 506, 470, 480, 481; 198/193, 203; 74/229, 215

[56] References Cited

UNITED STATES PATENTS

| | | | |
|---|---|---|---|
| 645,061 | 3/1900 | Benson | 209/433 |
| 776,662 | 12/1904 | Horn | 209/433 |
| 992,568 | 5/1911 | Loutensock | 209/430 X |
| 1,083,058 | 12/1913 | Craven | 209/429 |
| 1,423,130 | 7/1922 | McCoy | 209/506 X |
| 1,781,971 | 11/1930 | Bielenberg | 209/429 X |
| 2,800,994 | 7/1957 | Hill | 174/229 X |
| 3,050,178 | 8/1962 | Stone | 198/193 X |
| 3,310,161 | 3/1967 | Kraft | 198/193 |

*Primary Examiner*—Frank W. Lutter
*Assistant Examiner*—Ralph J. Hill
*Attorney, Agent, or Firm*—Newton, Hopkins & Ormsby

[57] ABSTRACT

A Process and Apparatus for use in concentrating an aggregate mixture of particles, such as minerals and non-minerals wherein the mixture is introduced onto an inclined endless conveyor adjacent one edge of the incline and is advanced along or parallel to the incline while water is flowed across the inclined surface and the aggregate mixture during the advancement causing the lighter particles to flow with the water down and off of the inclined conveyor while the heavier particles cling to and are advanced with the conveyor surface to a collection area. The endless conveyor includes a plurality of slightly raised ribs on the upper surface which define recesses therebetween for catching and holding the heavier particles during advancement of the conveyor. The raised ribs can be formed into a number of various patterns. The endless conveyor also includes a plurality of horizontally spaced, downwardly projecting tits which form a reduced friction support surface and conveyor engagement drive means. The water is sprayed from a plurality of spaced jets which can be arranged for directing streams transversely across the conveyor or longitudinally along the conveyor.

9 Claims, 15 Drawing Figures

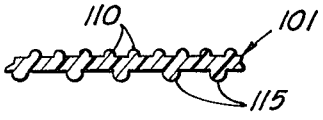
FIG 12
FIG 13
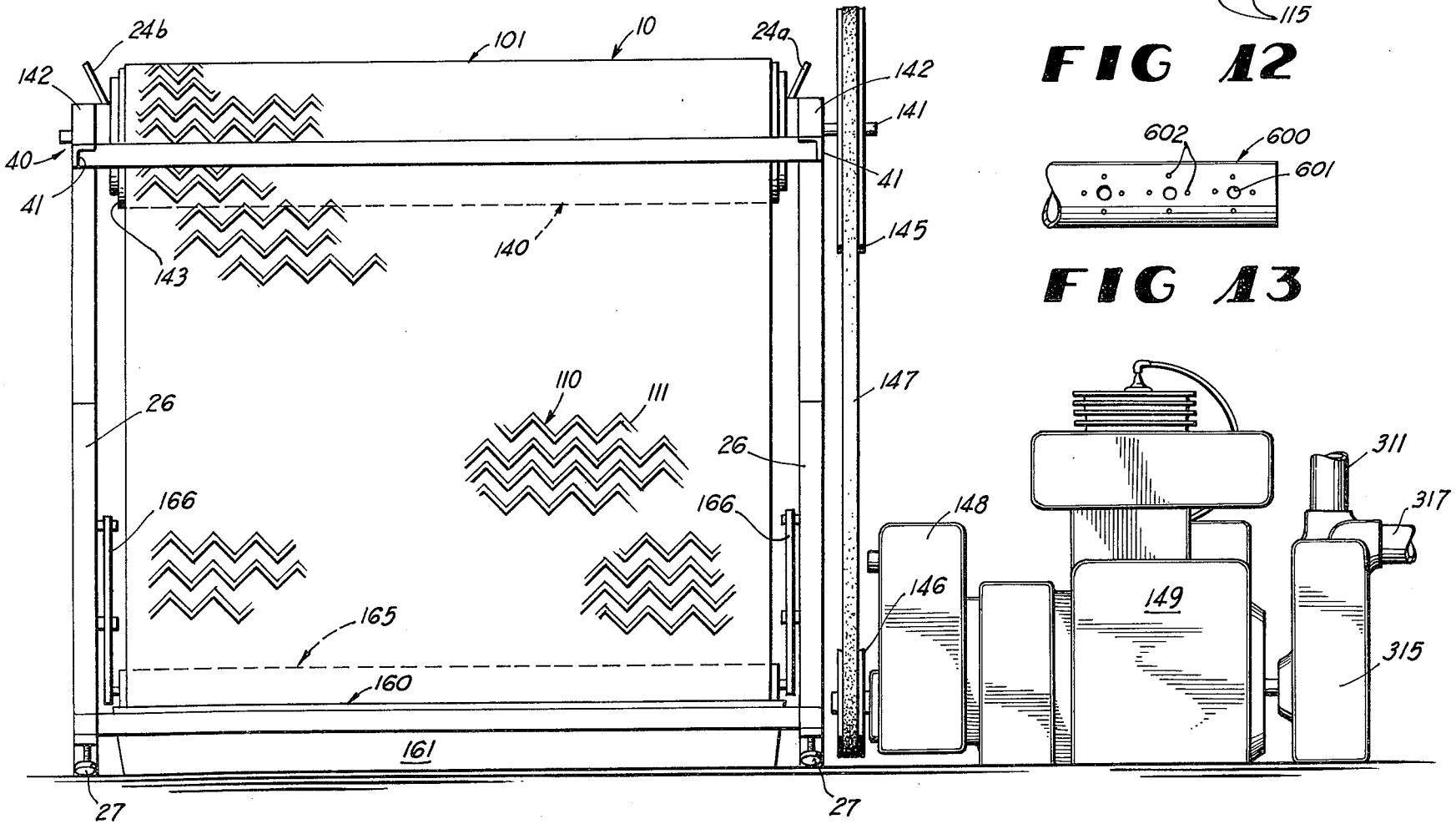
FIG 3

MATERIAL CONCENTRATOR

BACKGROUND OF THE INVENTION

This invention relates to a material concentrator and is more particularly concerned with a process and apparatus for separating and collecting desired minerals, such as gold, from an aggregate mixture of materials.

Considerable effort has been devoted to apparatus and processes for separating and collecting valuable minerals. Certain of these processes require considerable amounts of water, require the handling of tremendous amounts of material or often require excessive amounts of undesirable particles to be transported along with the desired particles to areas whereby a concentrating operation can be performed. The prior art concentrating apparatus are heavy, bulky, complex in construction and not always dependable in operation.

There are many valuable mineral deposits located in remote regions whereby the economics of utilizing the prior art apparatus and processes do not allow these minerals to be obtained.

Further, the prior art apparatus does not offer suitable means for concentrating fine particles to collect the valuable minerals and the tremendous cost of trying to collect the desired minerals overrides the value of those minerals obtained.

SUMMARY OF THE INVENTION

The above indicated objects and disadvantages have been overcome by the present invention which basically includes a process utilizing liquid flow and the inertia and specific gravity of particles for separating and collecting valuable minerals from an aggregate mixture.

One important feature of the present invention includes the advancement of a textured surface conveyor means over an inclined support, directing streams of water onto the conveyor surface and introducing an aggregate mixture of material onto the conveyor surface for movement with the conveyor means through the streams of water whereby the lighter particles will flow with the streams of water off of the conveyor in one direction and the heavier particles will cling to the conveyor surface for transfer along another direction to a collection area.

It is therefore a primary object of the present invention to provide a material concentrator which permits minerals to be separated according to their specific gravity.

Another object of the present invention is to provide an improved conveyor system for use with a material concentrator.

A further object of the present invention is to provide a conveyor drive and guide system for use with a material concentrator.

Another object of the present invention is to provide an improved conveyor surface for use with a material concentrator.

Still another object of the present invention is to provide a liquid flow and control system for use with a material concentrator.

An additional object of the present invention is to provide an improved material concentrator and process which is simple in construction and use, economical to manufacture and operate and reliable in performance.

These and other objects and advantages of the details of construction will become apparent after reading the following description of the illustrative embodiment with reference to the attached drawings wherein like reference numerals have been used to refer to like parts throughout the several Figures.

BRIEF DESCRIPTION OF THE DRAWINGS

FIG. 3 is end elevational view as seen from the right of FIGS. 1 and 2.

FIG. 12 is a sectional view taken along lines 12—12 of FIG. 8.

FIG. 13 is a fragmentary side elevational view showing the details of a water spray conduit.

DESCRIPTION OF THE ILLUSTRATIVE EMBODIMENT

Figure 1:
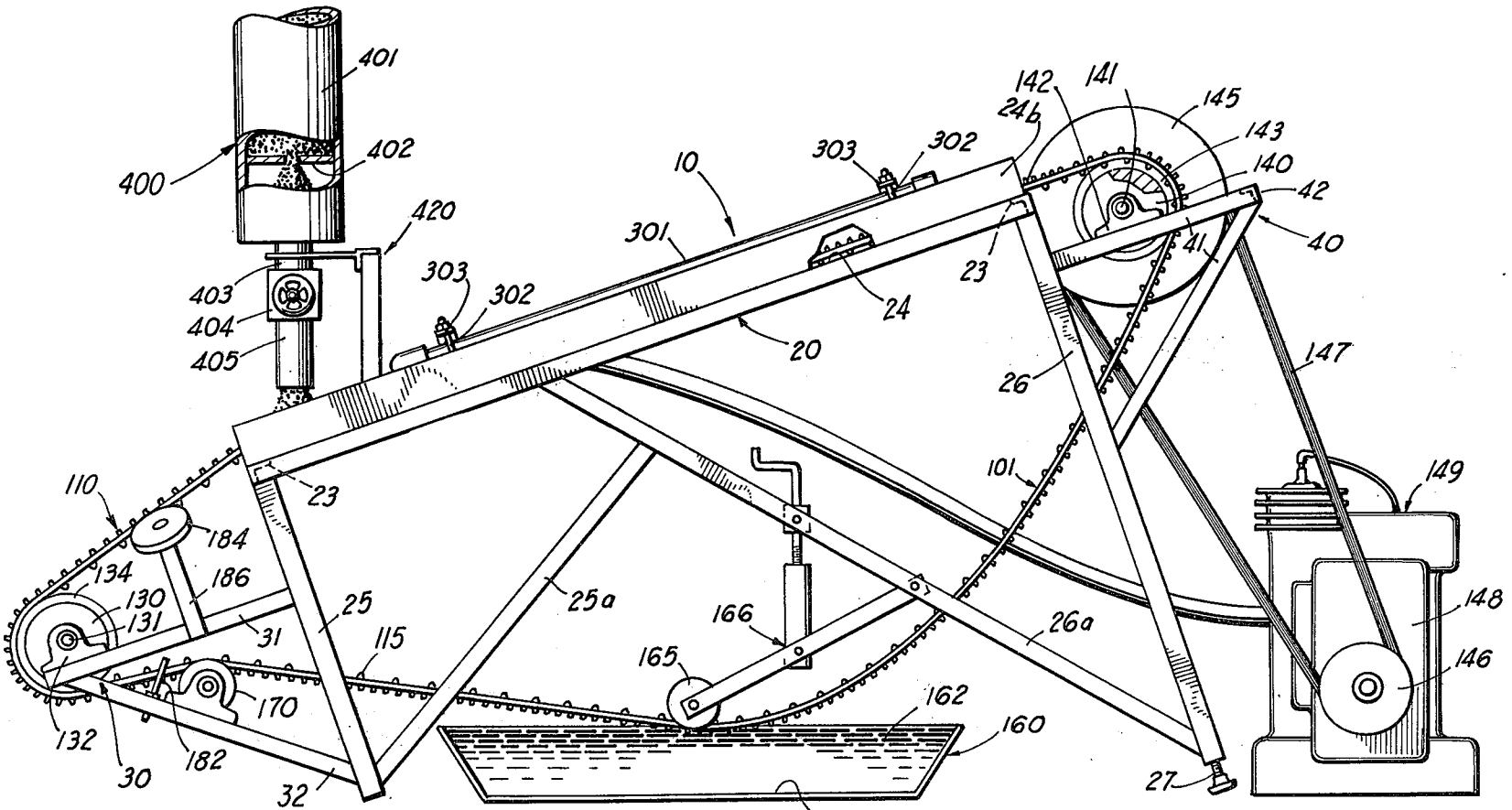
FIG. 1 is a side elevational view of the material concentrator embodying the principles of the present invention with parts broken away and shown in section for purpose of clarity.

Referring to the drawings, the material concentrator embodying the principles of the present invention is generally represented by the reference number 10 (FIGS. 1–3) and will be described with reference to a frame support means 20, material conveyor system 100, water spray system 200 and material introduction means 300.

The frame support means 20 is constructed from conventional metal stock materials such as angle iron, flat metal stock elements and sheet metal which are connected by conventional welding and threaded bolt means (not shown). Frame support means 20 includes an inclined deck 21 constructed from fore and aft angle elements 22 and transverse angle elements 23 which support a sheet metal deck member 24. Deck 21 is supported in an inclined position (FIG. 1) by spaced sets of leg members 25, 26 which include brace members **25*a*, 26*a*, with the set of leg members 26 being provided with threaded adjustment members 27 for use in adjusting the angle of deck 21. Transverse connecting members 28, are provided adjacent a lower end and between sets of legs 25, 26,** respectively.

Figure 2:
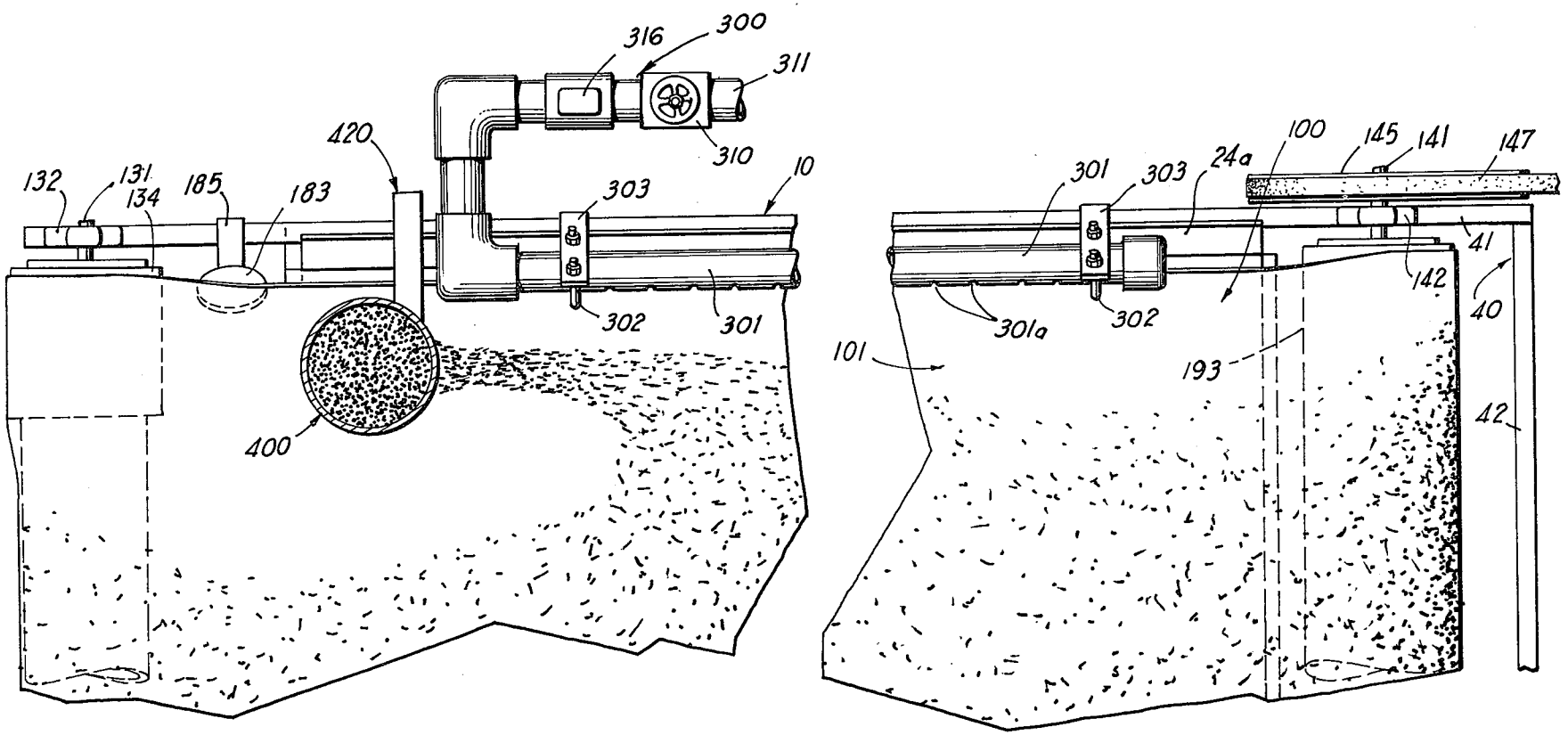
FIG. 2 is a top plan view of a portion of the material concentrator shown in FIG. 1.

As shown in FIGS. 1 and 2, the frame support means 20 includes a lower frame extension 30 having frame elements 31, 32 and an upper frame extension 40 having frame elements 41, 42. The frame extensions 30, 40 are provided for supporting the conveyor system 100 as will be described herein below. The above described frame support means 20 is lightweight, portable and can be easily transported to and assembled in remote areas where valuable mineral deposits are located.

Figure 11:
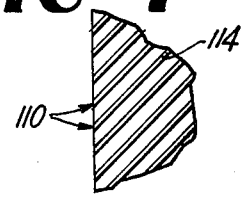

The conveyor system 100 includes an endless conveyor belt 101 constructed of suitable synthetic material, such as plastic or rubber. Belt 101 is formed by utilizing a predetermined length of material which can be joined by suitable connecting means, such as a snap member, for forming the predetermined length of material into endless belt 101. As shown in FIGS. 8–11, the endless conveyor 100 includes an upper conveying surface having a plurality of spaced ribs 110. The ribs 110 project slightly above the conveyor belt surface and provide recesses therebetween which trap heavier particles for transfer to a collection area. The spaced ribs 110 can be formed to represent a number of patterns, varying from angularly shaped, transversely oriented ribs 111 (FIGS. 3 and 8), sinous wave shaped ribs 112 (FIG. 9), straight, transversely oriented ribs 113 (FIG. 10), to straight, angularly oriented ribs 114 (FIG. 11). Also, the ribs can be designed to represent spaced individually shaped squares, circles or other figure elements (not shown).

As shown in FIGS. 1 and 12, the conveyor belt 101 includes a plurality of horizontally spaced downwardly projecting tit elements 115 which provide a reduced contact area of the conveyor in engagement with the deck pan 24, thus reducing the friction therebetween. Also, the downwardly projecting tits 115 provide positive engagement with the conveyor drive cylinder, as will be described in more detail below. However, the tit elements 115 can be eliminated and a series of rollers (not shown) can be provided for deck 22 for use in supporting conveyor 101.

The material conveyor system 100 includes a pair of conveyor belt support cylinders 130, 140. Cylinder 130 includes a support shaft 131 journaled within conventional bearings 132 mounted on the lower frame extension 130. Cylinder 30 includes a pair of axially spaced bands 133, 134 of sponge like material which provide a support for conveyor belt 101. The axial spacing between bands 133, 134 allows the conveyor belt to form a depressed curvature toward the middle of the conveyor belt along which the water and lighter particles can flow or be washed off into a collection source.

Cylinder 140 includes a support shaft 141 journaled within conventional bearings 142 mounted on the upper frame extension 40. A band 143 of sponge like material extends substantially along the axial length of drum 140 and provides a support for conveyor belt 101. The sponge like bands 133, 134 and 142 provide a conveyor belt engagement material which will allow the downwardly projecting tits 115 to effect a positive engagement with drive cylinder 140.

As shown in FIG. 3, cylinder shaft 141 extends through one of the bearings 142 and is provided with a pulley 145 which is drivingly connected to a drive pulley 146 by a conventional drive belt 147. Pulley 146 is operatively associated with a gear box 148 which is driven by a conventional power motor 149, such as an internal combustion engine. Operation of motor 149 will cause the conveyor belt 101 to be driven in a clockwise direction (FIG. 1) whereby the upper run of the conveyor belt 101 will be advanced up inclined deck 21 and so that the lower run of the conveyor belt 101 will be advanced through a collection zone wash station 160. Movement of the conveyor belt through the collection zone wash station 160 will cause the heavier minerals clinging to the conveyor belt 101 to be dislodged by water 162 for deposit in a collection pan 161. An idler roller 165 is supported in engagement with conveyor belt 101 adjacent collection zone wash station 160 so that the conveyor belt 101 will be guided through the wash water 162. Idler roller 165 is supported on the frame brace means **26*a* by a linkage and adjustment assembly 166.**

Figure 4:
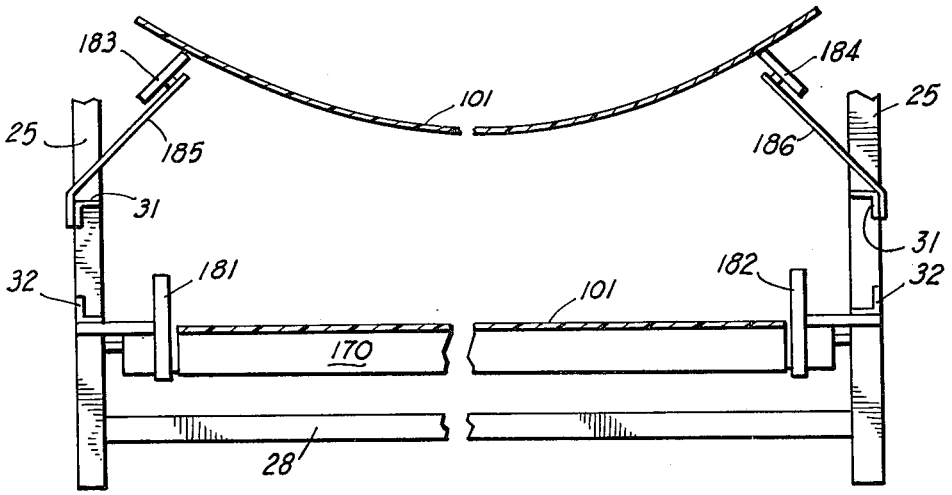
FIG. 4 is a vertical sectional view taken along a portion of the concentrator shown in FIG. 1.
Figure 5:
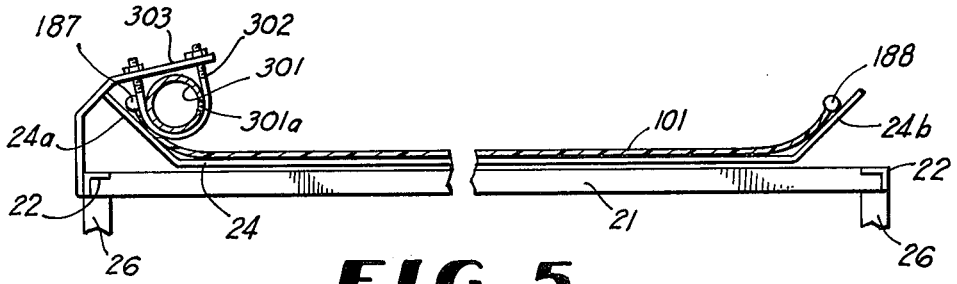
FIG. 5 is a vertical sectional view taken along a portion of the concentrator shown in FIG. 1.

As shown in FIGS. 1 and 4, the lower run of conveyor belt 101 passes over an idler roller 170 journaled on lower frame extension 30. The conveyor belt 101 is maintained in an aligned position on the support cylinders 130, 140 by a pair of guide bars 181, 182 supported adjacent opposite edges of the conveyor belt 101 on the lower frame extension 30. The conveyor belt 101 guide system also includes a pair of guide wheels 183, 184 rotatably supported by frame members 185, 186 which are secured to the lower frame extension 30. Guide wheels 183, 184 are detailed in angular orientation to engage the underside of the upper run of the conveyor belt 101 to form a depressed curvature in the upper run of the conveyor belt 101 for use in directing the flow of water and lighter material. FIG. 5 shows the details of guiding the conveyor belt 101 along deck member 24. Deck member 24 includes upturned lateral edges **24*a* 24*b* which aid in turning the lateral edges of the conveyor belt 101 upwardly to prevent material from flowing laterally off the conveyor belt 101. A pair of guide rods 187, 188 are secured to deck member edges 24*a*, 24*b*, respectively for maintaining the conveyor belt in an aligned position relative to deck 24.**

The water spray system 300 is shown in FIGS. 1–3 and includes an elongated spraying conduit 301 which is supported substantially parallel to and above one lateral edge of conveyor belt 101. Conduit 301 is supported by a pair of axially spaced clamps 302 secured to frame extension members 303. Conduit 301 includes a plurality of axially spaced openings **301*a* detailed in angular orientation for directing streams of water transversely across the conveyor belt (as shown in FIGS. 2 and 5). Conduit 301 is connected through a control valve 310 and supply line 311 to a pump 315 which is drivingly connected to motor 149 (FIG. 3). A pressure gauge 316 is operatively associated with the spraying conduit 301 for use in monitoring the pressure of water sprayed through openings 301*a*, which pressure is regulated by control valve 310. Pump 315 is provided with a conventional input supply line 317** which is in flow communication with a water supply source (not shown).

An aggregate mixture of material is supplied to the material concentrator 10 by a material introduction system 400 which includes a supply hopper 401 having a metering baffle 402, a supply conduit 403, control valve 404 and supply nozzle 405. The supply hopper 401 and its associated parts are supported by an upwardly directed frame extension and clamp means 420 which is mounted on the frame deck 21 in a position for introducing the aggregate mixture of material onto the conveyor belt 101 adjacent a lower corner edge portion of conveyor 101 and adjacent and down stream of water supply conduit 301 whereby the material will be progressively advanced by conveyor belt 101 upwardly past streams of water sprayed through conduit openings **301*a* in response to operation of the conveyor system 100.**

Figure 6:
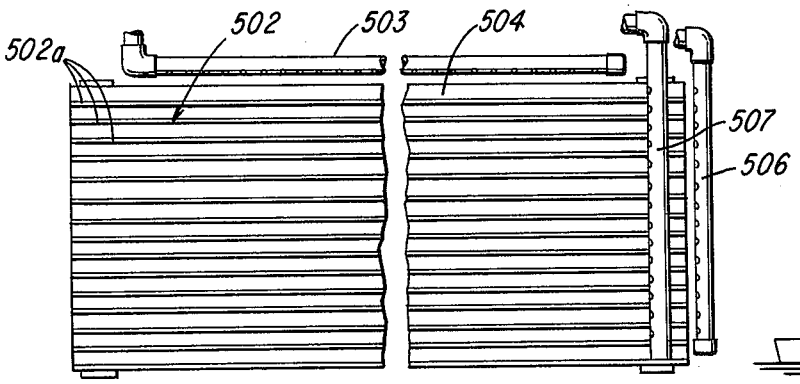
FIG. 6 is a top plan view of an alternate form of the material concentrator.
Figure 7:
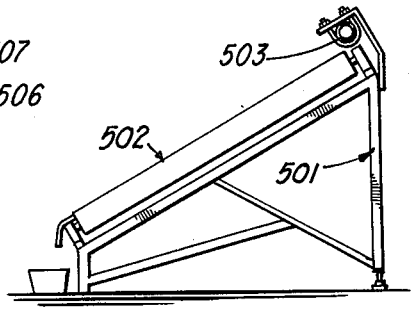
FIG. 7 is an end elevational view as seen from the left of FIG. 6.
Figure 8:
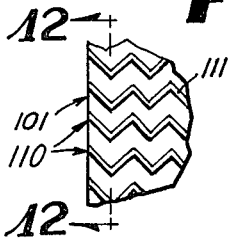
FIGS. 8–11 are fragmentary plan views showing details of design of the conveyor.
Figure 9:
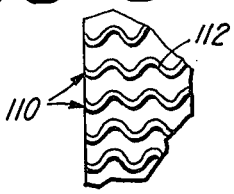
Figure 10:
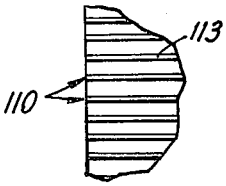

FIGS. 6 and 7 show an alternate embodiment of the material concentrator which is generally represented by number 500 and includes a conventional frame support system 501, an endless material advancing conveyor system 502, and a water spray system 503. The frame support system 501 and a conveyor system 502 are detailed in construction so that the conveyor 504 is inclined in a direction transverse to the direction of movement of the conveyor and wherein the water supply system 503 is operable for directing streams of water transversely across the conveyor. The water spray system 503 may include additional spray conduits 506, 507, with conduit 506 operable for directing streams of water onto the upper run of conveyor 502 substantially parallel to the direction of movement of the conveyor 504 and wherein conduit 507 is operable for directing streams of water onto the lower run of the conveyor for use in collecting the heavier minerals which cling to the surface of conveyor 502. Conveyor 502 includes a plurality of spaced ribs 502*a* which project above the surface of the conveyor for defining recesses for collecting the heavier valuable minerals. Ribs 502*a* are oriented to be parallel to the direction of movement of the conveyor 504, as shown in FIG. 6,

FIG. 13 shows the details of a water supply conduit 600 which includes a plurality of axially spaced major spray openings 601, with each opening 601 be surrounded by a plurality of circumferentially spaced minor spray openings 602. The water spray conduit can be associated with either of the material concentrator systems 10 or 500.

Figure 14:
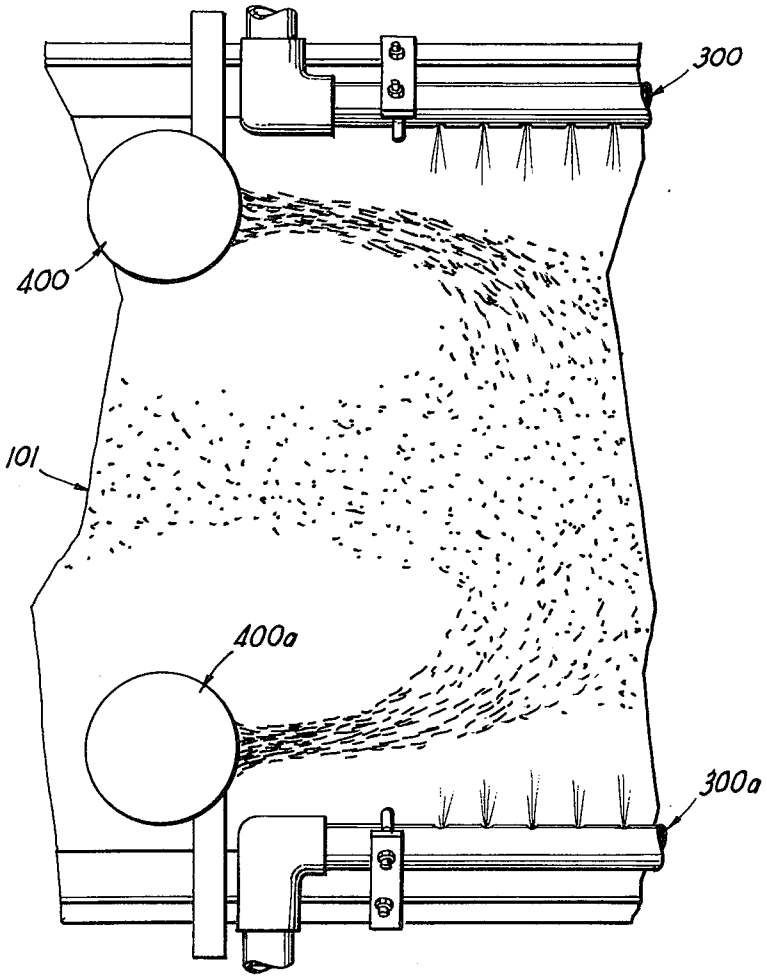
FIG. 14 shows a top plan view of an alternate embodiment.

FIG. 14 shows a modification of the material concentrator shown in FIGS. 1–4. The modification provides for the use of a second material discharge hopper 400*a* and a second water spray system 300*a* located on an opposite side of the conveyor 101 from discharge hopper 400 and spray system 300 whereby the capacity of the concentration system can be increased. Further, in supplying the mixture of material to the concentration system, the material can be supplied in a slurry form to eliminate dust and to allow the use of various types of conveyor system for delivering the material to the feed-hopper.

Figure 15:
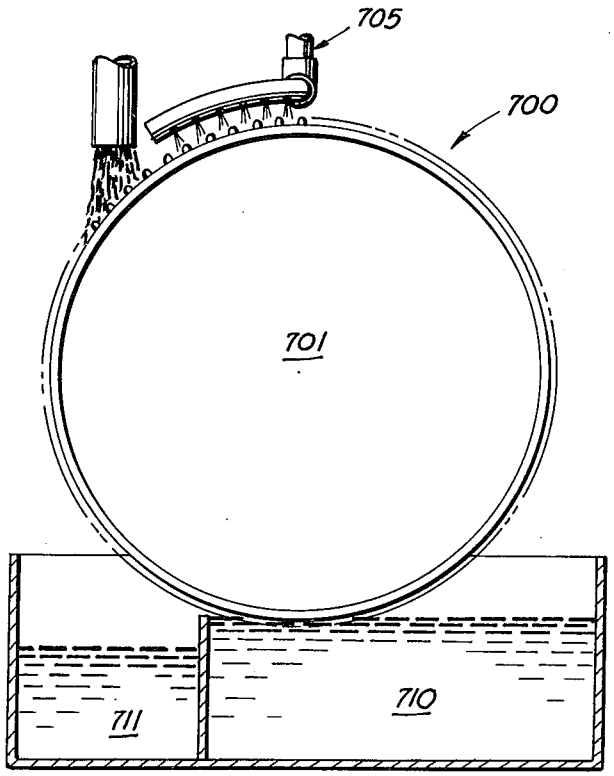
FIG. 15 shows an end elevational view of still another embodiment.

FIG. 15 shows a further embodiment 700 of the material concentration system wherein the conveyor means is constructed in the form of a larger cylinder 701 which includes an upper ribbed surface. The material concentration system includes a water spray system 705 and a particle collection vat 710. A second vat 711 is associated with cylinder 705 for catching the run-off water and waste particles.

OPERATION

In utilizing the material concentrator 10 to separate and collect valuable minerals, the power motor 149 is started to effect operation of the conveyor system 100 and to effect operation of the water spray system 300. Operation of the conveyor system 100 will cause the upper run of conveyor belt 101 to be advanced up along inclined deck member 24 (clockwise direction FIG. 1), with the conveyor surface moving past the water spray conduit 301, over drive cylinder 140 and with the lower run of the conveyor being advanced through the collection zone wash station, around cylinder 130 for return along the inclined deck 24. After the conveyor belt 101 and water spray operation has been started, the material hopper 401 is supplied with an aggregate mixture of material, control valve 404 is opened and the mixture of material is introduced onto the conveyor belt 101 and advanced past the streams of water flowing from spray conduit 301. As the mixture of material moves past the spray conduit, the streams of water will progressively break up the material, causing the lighter minerals to flow along the conveyor belt 101 with the streams of water, with the water and lighter particles flowing off the lower end of the conveyor belt 101.

In response to separation and flow of the lighter particles off the conveyor belt 101, the heavier particles will be trapped in the recesses formed between the upstanding ribs 110 and will be advanced over the upper end of the conveyor belt 101 for deposit in the collection pan 161.

The alternate embodiment 500 shown in FIGS. 6 and 7 operates similar to the material classifier 10 except that the conveyor 504 is inclined transversely with the water spray and lighter material flowing off of a lateral edge of the conveyor 504 opposite from the water spray conduit 503.

It now becomes apparent that the above described illustrative embodiments are capable of obtaining the above stated objects and advantages,

What is claimed is:

1. Process of concentrating the heavy constituents of an aggregate mixture, comprising:

a. passing a continuous flexible belt having upstanting spaced ribs transversely thereof in a closed path about spaced parallel, upper and lower transverse axes so that the upper flight of said belt moves upwardly along an incline;

b. flexing said upper flight so that the upper flight extends inwardly and downwardly toward its central portion as it moves upwardly along the incline;

c. depositing said aggregate mixture in a stream onto one edge portion of said upper flight and at a position where it begins its upward movement;

d. directing water laterally from above said one edge portion of said upper flight inwardly onto said upper flight for contacting said aggregate mixture and for washing the lighter particles of said aggregate mixture down said inclined upper flight as the heavier particles thereof are carried by said belt over the upper axis and is then carried downwardly by the lower flight of said belt; and e. removing said heavier particles from said lower flight.

2. Process defined in claim 1 wherein said ribs are respectively formed of angularly oriented segments zigzagging across said belt.

3. The process defined in claim 1 wherein said heavier particles cling to said lower flight and the step of removing said heavier particles includes passing a portion of said lower flight progressively through water disposed in a collection pan.

4. The process defined in claim 1 including the step of depositing additional aggregate material in a stream onto the other edge portion of said upper flight and at a position where it begins its upward movement; and directing water laterally from above said other edge portion of said upper flight inwardly onto said upper flight for contacting the additional aggregate material and for washing the lighter particles of said aggregate material down said inclined upper flight as the heavier particles thereof are carried by said belt over the upper axis and is carried downwardly with the heavier particles from the initial aggregate mix.

5. An apparatus for use in concentrating an aggregate mix of particles, such as minerals, comprising in combination:

a. a frame support means defining an incline; a pair of rollers carried by said frame support means with their axes disposed parallel to each other and transversely of said frame, one of said axes being disposed forwardly of and above the other of said axes;

b. a continuous flexible belt draped over said rollers, said belt having upstanding, angularly oriented, transversely extending, spaced, substantially complimentary ribs throughout the outer surface of said belt, said belt defining an upper flight passing at an incline upwardly over the upper roller and defining a lower flight passing downwardly and thence to the lower roller;

c. a liquid spray means supported adjacent one edge of the upper flight of said belt for spraying a liquid medium onto said belt;

d. means for feeding an aggregate mix onto said belt adjacent the lower corner of said upper flight so that said aggregate mixture is progressively carried upwardly by said upper flight so that said liquid medium contacts said aggregate mix, whereby lighter particles thereof are separated from said aggregate mix and flow with said liquid medium down along said inclined surface and the heavier particles thereof cling to said belt as said belt passes over said upper roller and also clings to said belt as the lower flight passes downwardly; and e. means for removing said heavier particles from said lower flight.

6. The apparatus defined in claim 5 wherein said means for removing said heavier particles from said lower flight includes a pan supporting water in a position so that the upper surface of said water contacts said lower flight.

7. The apparatus defined in claim 6 including means for adjustably submerging said lower flight in said water.

8. The apparatus defined in claim 5 wherein said ribs form a herring bone pattern.

9. The apparatus defined in claim 5 including a second means for feeding aggregate mix onto said belt adjacent a lower corner opposite to said first mentioned lower corner and second liquid spray means adjacent the other edge of said belt for spraying water onto the aggregate mix deposited by said second means.

* * * * *